United States Patent [19]

Mimoun

[11] Patent Number: 4,723,737

[45] Date of Patent: Feb. 9, 1988

[54] PROCESS AND DEVICE FOR TRANSMITTING DATA BETWEEN VEHICLES MOVING OVER A TRACK

[75] Inventor: Samuel Mimoun, Paris, France

[73] Assignee: Matra Transport, Paris, France

[21] Appl. No.: 788,721

[22] Filed: Oct. 17, 1985

[30] Foreign Application Priority Data

Oct. 18, 1984 [FR] France ..... 84 15977

[51] Int. Cl.[4] ..... B61L 23/24

[52] U.S. Cl. ..... 246/2 S; 246/167 R; 246/182 R; 246/187 A; 340/47; 364/460

[58] Field of Search ..... 364/460, 461; 246/2 E, 246/2 F, 2 S, 167 R, 167 D, 168, 182 R, 182 C, 186, 187 R, 187 A, 187 B, 187 C; 343/6.5 SS; 340/47, 48; 371/69; 342/70, 137

[56] References Cited

U.S. PATENT DOCUMENTS

| | | | |
|---|---|---|---|
| 2,762,913 | 9/1956 | Jepson | 340/47 |
| 3,337,866 | 8/1967 | Gisonno | 364/461 |
| 3,384,033 | 5/1968 | Ruff | 246/182 R |
| 3,532,228 | 10/1970 | Beyer | 213/212 |
| 3,790,780 | 2/1974 | Helmcke et al. | 246/187 C |
| 3,937,432 | 2/1976 | Birkin | 246/187 B |
| 3,992,698 | 11/1976 | Sahasrabudhe et al. | 246/187 B |
| 4,133,504 | 1/1979 | Dobler et al. | 246/187 B |
| 4,279,395 | 7/1981 | Boggio et al. | 246/187 B |
| 4,578,665 | 3/1986 | Yang | 246/167 D |
| 4,582,280 | 4/1986 | Nichols et al. | 246/167 R |

FOREIGN PATENT DOCUMENTS

| | | | |
|---|---|---|---|
| 2127791 | 12/1972 | Fed. Rep. of Germany | 246/2 F |

*Primary Examiner*—Robert B. Reeves
*Assistant Examiner*—Donald T. Hajec
*Attorney, Agent, or Firm*—Larson & Taylor

[57] ABSTRACT

For data communication in the form of messages between railways vehicles moving over a same track, short identical emissions at random times by modulating a directional microwave beam whose angular opening is sufficient in the horizontal direction for maintaining communication in bends of said track and switches and in the vertical direction for maintaining communication during changes in the profile of the track.

9 Claims, 9 Drawing Figures

PROCESS AND DEVICE FOR TRANSMITTING DATA BETWEEN VEHICLES MOVING OVER A TRACK

TECHNICAL FIELD OF THE INVENTION

The invention relates to the transmission of data, without a material support, between vehicles moving over a same track, particularly with a view to detecting the relative position of two successive vehicles and the transmission of the information required for automatic control of one of the vehicles. The invention is suitable for use in public transport installations using vehicles of a relatively small capacity (ten to twenty seats for example), which may be coupled together by electronically controlled means so that the vehicles may be separated when passing over a divergent switch, then coupled together again in a different arrangement. As an example of such transportation system, reference may be made to the "ARAMIS" system developed by the assignee of the present invention.

BACKGROUND OF THE INVENTION

High speed transmission of data in a railroad environment presents problems which are difficult to solve. The rate of communication failures (undetected error or lack of communication) must be very low so as to be compatible with safety requirements. The use of the available material carriers, such as power transmission lines (overhead lines or surface lines) does not allow sufficiently high data transmission rates to be attained for installations achieving automatic control and automatic separation and regrouping of the vehicles. The use of transmission channels without a material carrier seems at first sight to be excluded, due to the very variable character of the environment and to the risks of reflection, particularly on the walls of cuttings or tunnels and on vehicles moving over a parallel track.

Beams of ultra sounds, which have however the advantage of being very directional, have proved inappropriate. The use of hertzian waves, in the microwave range, also seems to be excluded due to possible reflection on fixed or moving obstacles and to the risk of collision, in the receiver, between messages actually intended for this receiver and other messages.

OBJECTS OF THE INVENTION

It is an object of the invention to provide a process and device for transmission over a microwave channel, which is safe in operation; it is a more specific object to reduce the risk of connection failure to an acceptable level.

SUMMARY OF THE INVENTION

A process for transmitting data, without a material carrier, between vehicles moving along a track in a railway environment, particularly for detecting the relative position of two successive vehicles in movement, includes sending the messages to be transmitted from each travelling vehicle, in the form of short repeated emissions at random times, by modulating a directional microwave beam whose angular opening is sufficient in the horizontal direction for maintaining communication in bends and switches and in the vertical direction for maintaining communication during changes in the profile of the track.

The message is advantageously repeated m successive times during a refreshment period T, each time at a random moment within a particular segment, of duration T/m, m being an integer typically of from 5 to 40. Since each message is very short, typically of a duration less than T/m by an order of magnitude, the probability of losing a message through collisions between messages is very low.

The messages may also be sent with a power which depends on the conditions met with, for example by selection between a nominal power and a reduced power. The nominal power is only used under conditions where high transmission reliability is required and where attenuation is great.

The invention also provides a data transmission device suitable for implementing the above-defined process. The device comprises, on each vehicle, a transmission unit and a reception unit each connected by a respective interface to data processing means, typically comprising one or more microprocessors. The transmission unit comprises a coupler for encoding and formatting data received from the data processing means and means for transmitting the data repeatedly, i.e. several consecutive times and randomly during a same refreshment period. The reception unit comprises a reception coupler, the purpose of which is to validate the message received before passing it to the data processing means.

The data processing means may comprise two microprocessors one of which for processing the "functional" data, the other for the "safety" data. This latter data will be advantageously transmitted in coded form with a code increasing the redundancy and the detection of errors.

For limiting the risks of message loss, the reception unit preferably comprises several antennae disposed at different positions in front of the vehicle. Two antennae will be typically used whose distance is at least equal to ten times the wave length in the air. With each antenna, formed generally by a horn, there is associated an amplifying chain with frequency change.

The invention will be better understood from the following description of a particular embodiment given by way of example.

SHORT DESCRIPTION OF THE DRAWINGS

FIGS. 1*a* and 1*b* are respectively front and elevational views of a transport vehicle in an installation which may include the invention;

FIGS. 2*a*, 2*b* and 2*c* are diagrams showing the operations which may be performed automatically on the network of an installation using the invention;

DESCRIPTION OF AN EMBODIMENT

It may be useful, before describing a particular embodiment of the invention, to give some indications about a public transport installation to which it may be applied.

The installation may comprise elementary transport units which may be grouped together in strings. They are provided for this purpose with an electronically controlled coupling assembly. Each elementary unit may be formed by an individual vehicle, such as the one shown in FIGS. 1*a* and 1*b* or a "doublet" formed of two vehicles joined together by a mechanical connection. Each vehicle has for example a capacity of ten seats.

The installation comprises a network of fixed tracks having switches and devices for detecting the location of the vehicles. It is arranged to allow different operations, including the simple versions shown in FIGS. 2*a*, 2*b* and 2*c*, in the particular case where vehicles leaving stations C and D are to serve stations A and B.

Figure 2A:
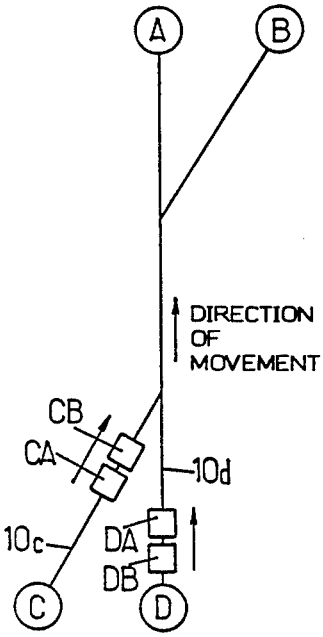
Figure 2B:
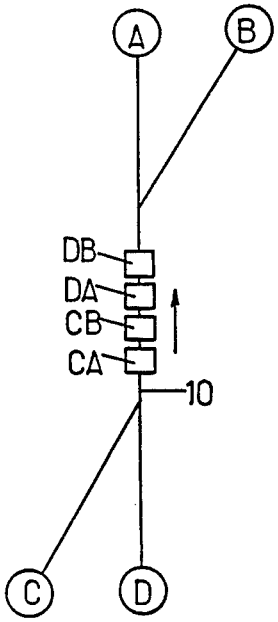

FIGS. 2*a* and 2*b* show the rendez-vous of two sets or strings coming from two convergent branch lines 10*c* and 10*d* so as to form a single set on a common section 10.

Figure 2C:
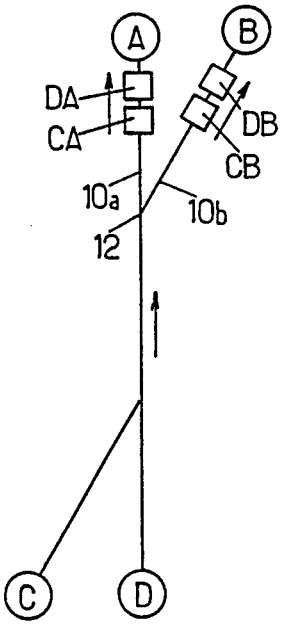

FIGS. 2*b* and 2*c* show the separation of the vehicles when passing over a divergent switch 12 then the rearrangement of the vehicles in groups having the same destination over branch lines 10*a* and 10*b*. The vehicles are identified in the three Figures by a combination of the letters identifying the departure station (C or D) and the arrival station (A or B).

With this principle, the length of the set of vehicles may be adapted to the transportation requirements. A latticed network may be designed which does not involve train change for the user and a high passage rate may be maintained, even at off-peak hours, since then the sets of vehicles will simply comprise a lesser number of units, which makes the system particularly attractive for commuters.

By way of example, in an installation, the interval between sets of vehicles may be as small as 35 seconds with a stopping time of 15 seconds, the maximum speed being 60km/hour and the regrouping and rendez-vous speed being of from 14 to 33 km/hour depending on the configuration of the track.

With short vehicles, having a capacity of ten persons, very small radii of curvature may be accepted during switching, by reducing the speed when passing over these switches. The device which will now be described is intended more especially for detecting a vehicle which will be subsequently termed "target vehicle", from a vehicle which follows it, which will be called the "follower vehicle", at a sufficiently large distance to ensure safety.

The device comprises, on each vehicle 14 (FIGS. 1*a* and 1*b*), a unit for rearward transmission and a unit for receiving the messages transmitted by a target vehicle. Microwaves (i.e. hyperfrequency waves at a frequency greater than 300 MHz and which typically are of some GHz) are used for transmission. The transmission will advantageously be asynchronous with a high level procedure such as HDLC. Zeroes are automatically inserted for avoiding the presence of an excessive number of consecutive "ones" in the messages. A binary, typically NRZ, code will generally be used. Among the NRZ codes, NRZI may be used in which the logic level at transmission changes when the bit to be transmitted is zero whereas there is no change of state when the bit to be transmitted is one. The HDLC procedure and NRZI coding in combination allow easy recovery of the clock.

The information transmitted may comprise a number identifying the track section over which the vehicle is travelling, an identification number for the vehicle, an indication of the position of the vehicle, an indication of the condition of the vehicle, the total number of vehicles in the set. The whole of this information, called safety information, is transmitted after encoding under a form providing the required level of safety.

Complementary information, which does not require the same level of safety, may also be sent.

The reception unit is provided for carrying out more especially the following operations on the information received from the target vehicle:

- comparison of the number of the target vehicle with a reference number, transmitted by the channel when the follower vehicle enters the section occupied by the target vehicle,
- calculation of the distance between the follower vehicle and the target vehicle and the relative closing up speed.

Figure 3:
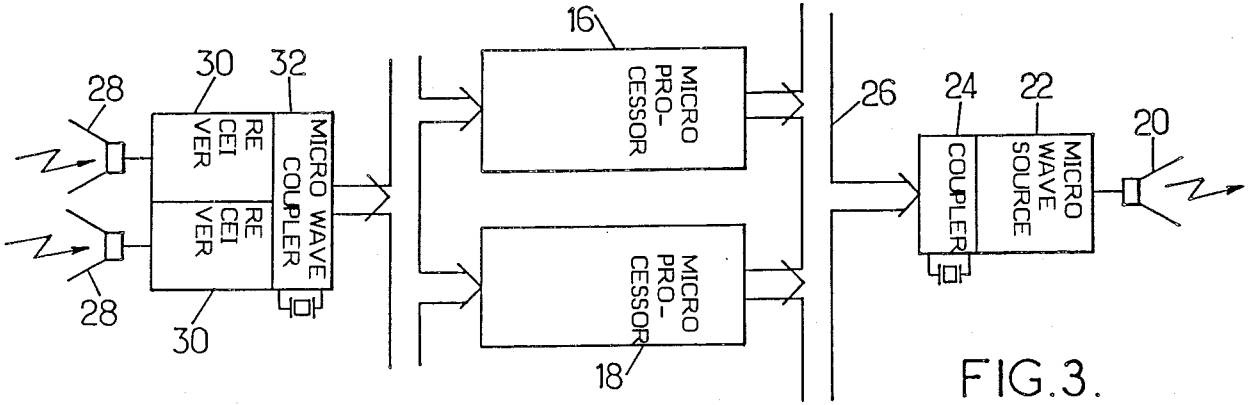
FIG. 3 is a block diagram of a device according to an embodiment of the invention.

Each vehicle 14 will accordingly comprise an emission unit and a reception unit (FIG. 3) both connected to a "functional" microprocessor 16 which processes the information received so as to determine the control law to be applied during regrouping or a rendez-vous and supplies the emitter unit with the information to be transmitted other than that concerning safety. The emitter and receiver units are also connected to a "safety" microprocessor 18 which processes the information received for monitoring the regrouping or rendez-vous as well as the running in sets of vehicles and which supplies the emitter with that information to be transmitted which relates to safety and is coded so as to provide the required redundancy.

The emitter unit may be considered as comprising an antenna 20, which will generally be a horn, an ultra high frequency source 22 and an emission coupler 24 connected to a bus 26 for connection with the microprocessors through an interface not shown.

The lobe provided by the horn 20 has a width which is a compromise between two contradictory requirements. This lobe must be sufficiently wide for visibility to be ensured in all the relative directions which the target vehicle and the follower vehicle may take, despite the movements of the vehicle (swaying and pitching) and despite the track structure which has bends and changes of slope. But the lobe must be sufficiently thin so that a vehicle travelling over another track than the vehicles between which the communication is to be established, in the same direction or in the reverse direction, does not disturb the ultra high frequency beam over the useful range; in addition, the beam must be sufficiently thin for the echos from the walls to be tolerable. This latter condition will generally lead to placing the horn 20 in the vertical axis of symmetry, at a height of the order of 1.25m for the usual gauges.

The angular width of the lobe in the vertical direction will naturally depend on the accepted profile for the track and on the maximum pitching amplitude. In practice, an angular width of 20° will generally be satisfactory.

In the horizontal direction, the criteria to be taken into consideration for determining the minimum value will be the maximum swaying amplitude of the vehicle, a minimum radius of curvature of the track and the need for visibility during switching. The choice will be made as a function of each particular installation.

Figure 1A:
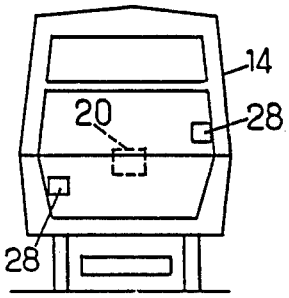
Figure 1B:
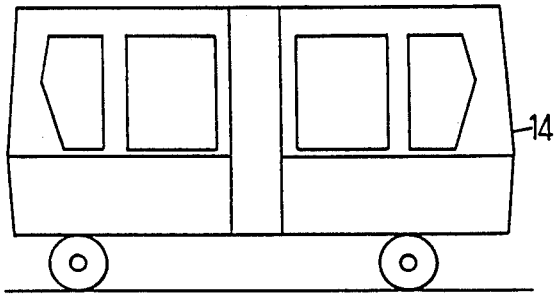

So as to improve reception, the receiver assembly advantageously comprises two channels, each having an antenna 28 and a receiver 30. The presence of two antenna provides a diversity of reception positions. The antennae 28 may more especially be situated on each side of the vertical plane of symmetry of the vehicle 14 and at different heights (FIG. 1A). The two chains are connected to the same ultra-high frequency coupler 32, comprising an input means which either selects the most favorable channel or sums the two channels.

The emitter unit is advantageously provided so as to operate at several power levels, for example at zero power (emitter switched off), at reduced power and at nominal power. The power level will be determined by an order elaborated locally as a function of the indications received from the track or other detection elements. The parameters taken into consideration may more especially be the following:

presence or not in a regroupment zone, reception or not of a remote order for regrouping with the target vehicle, detection or not (for example by an ultra sonic connection between vehicles) of the presence of the follower vehicle, recognition of the presence or not in a divergent switching zone, reception or not of a remote activation command.

The nominal power configuration may more especially be provided under the following conditions:

1. Regroupment between vehicles, identified by the recognition of a regroupment zone and reception of the remote regroupment command.

2. Passage through a divergent switching zone with possibility of separation of the vehicles on the two branch lines of the switch, identified by detecting a rear presence and the recognition of a divergent switching zone (the nominal power configuration making is easier to pass over a divergent switch because of the suppression of blind zones).

3. Degraded operating mode in the case of break up of a set of vehicles and automatic reconfiguration, the nominal power transmission being caused by remote command.

The reduced power configuration will be chosen after nominal regrouping (switching from nominal power to reduced power) or after preparation of the element in the sidings (switching from zero power to reduced power).

Generally, the choice between the power levels (nominal or reduced) will be made by taking into account two parameters, the desired range and curvature of the track.

The emitter unit and the receiver unit may be formed from conventional components, but which are put into use in accordance with the process which reduces the risk and consequences of collisions between messages.

A 9.9 GHZ connection may be more especially adopted with on-off amplitude modulations at a rate going from 20Kbits per second to 2 Mbits per second.

The purpose of the ultra high frequency emission coupler 24, connected by an interface to the bus 26 of microprocessors 16 and 18, is to code and format the data received from the microprocessors in the coded NRZ form, then to time the sending of the packet of elementary bits to the emitter 22 in accordance with an algorithm such that the emission takes place at a high timing rate (typically 1 Mbit per second), repetitively and randomly.

The coding may more especially consist in causing the message to pass from the NRZ code to the NRZI code. The formatting may more especially use the HDLC transmission protocol, which involves the automatic insertion of zeros. The association of the NRZI coding and the use of the HDLC protocol results in the presence of a transition whenever the bit to be transmitted is a zero and after five consecutive "ones".

In the case of the transmission of messages of at least 140 bits, including the coding bits associated with the safety data, the message to be transmitted may have the following format:

a leading flag, for providing clock synchronization, the message properly speaking of indeterminate length, a vehicle set sequence, for detecting errors, occupying two 8 bit bytes, a trailing flag, occupying an 8 bit byte.

Of course, instead of using an ansynchronous connection with the HDLC protocol, a two phase synchronous transmission may be adopted with repetition of clock recovery patterns.

In accordance with the invention, the emission of the same message (occupying at most 190 bits in the case envisaged here) is repeated several times during the same refreshment period. This period will depend on the desired performances, particularly those concerning the regrouping speed. In a high rate public transport installation, it may go from a few milliseconds to a few tens of milliseconds.

Figure 4:
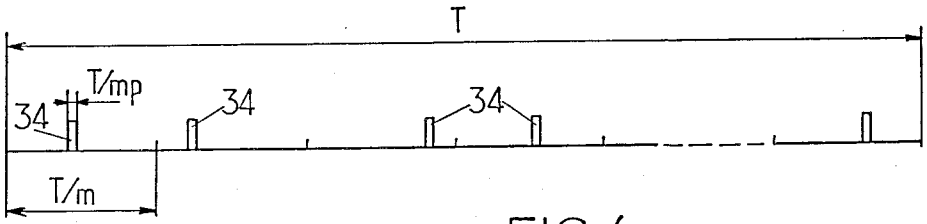
FIG. 4 is a timing diagram showing a distribution in time of the messages transmitted in the device of FIG. 3.

As shown in FIG. 4, the refreshment period t is divided into m segments of the same duration T/m. Each of the messages to be transmitted, indicated at 34, must have a brief duration with respect to each segment T/m. Each message is given a position in the segment which is random. By adopting a transmission rate greater than or equal to one Mbit per second, values of mp exceeding 100 with a refreshment period of 20 milliseconds may be readily achieved, which reduces the probability of collisions to a very low value, even in the case of a large number p of disturbing vehicles (i.e. vehicles which, at a given time, because of their position and because of the power of their emitter may influence the receiver which receives the message).

In each particular case, the optimum number m of segments in the refreshment period may be calculated, particularly as a function of the transmission rate, of the length of the messages and of the number of disturbing vehicles. As a general rule m will be between 5 and 40.

The ultra high frequency emission coupler will be of conventional construction; it may comprise a microprocessor (INTEL 8044 for example) associated with a memory storing the whole of the message to be transmitted and a memory containing the formatting and coding program as well as the algorithm in a form readable by the microprocessor. This coupler will be connected to the emission bus through an interface formed by a data exchange register, a command register written by the microprocessor of the coupler, a state register read by the microprocessor and an information register.

The ultra high frequency emitter 22 comprises a source and an amplitude modulator which receives the message to be emitted from the coupler 24 in the form a NRZ signal.

Figure 5:
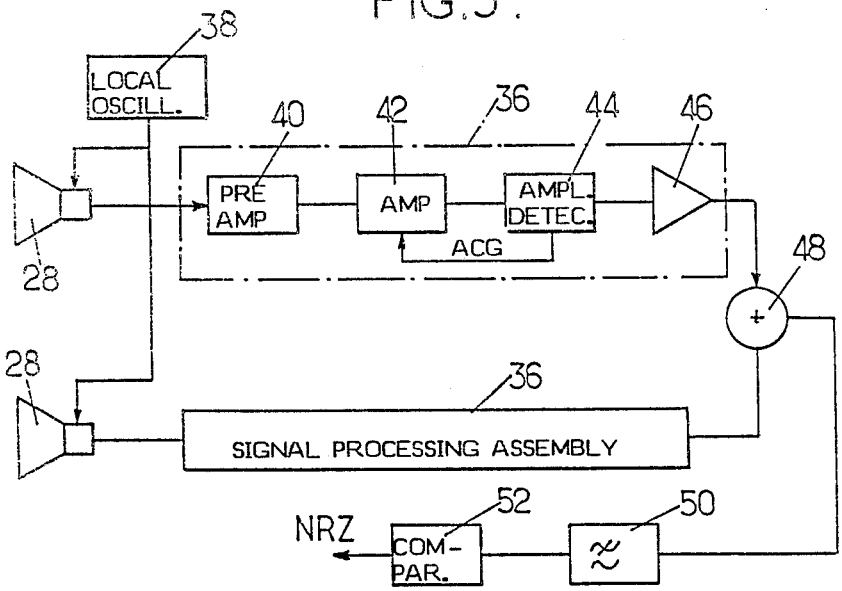
FIGS. 5 and 6 are block diagrams showing respectively a receiver and a reception coupler usable in the device of FIG. 3.

The receiver unit of the vehicle comprises, for each reception antenna, a complete chain 36 only one of which is shown in FIG. 5. Each chain receives a signal picked up by the antenna, after frequency transposition by beating with a carrier supplied by a local oscillator 38. The transposed frequency signal, at 70 MHz for example, is applied to a low noise preamplifier 40, followed by an amplifier 42 with automatic gain controlled by a signal supplied by a detector 44. The low frequency signal from the detector is applied to a video preamplifier 46. The outputs of the two video preamplifiers are applied to the inputs of summing circuit 48.

The resultant signal is applied to a low pass filter 50 then shaped in a comparator 52 before being fed, in the form of a NRZ signal, to the reception coupler 32.

Figure 6:
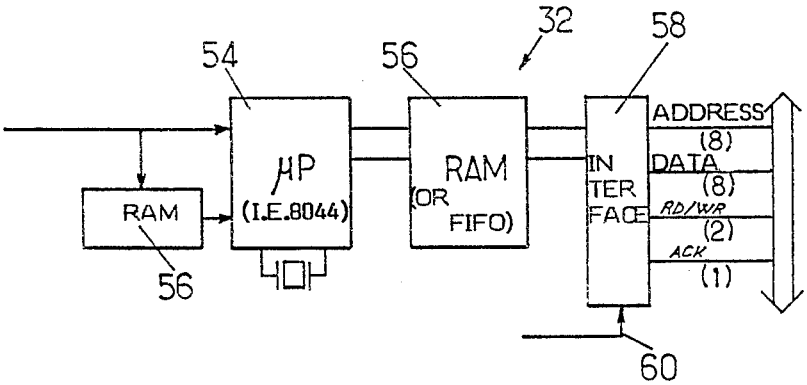

The ultra high frequency reception coupler 32 (FIG. 6), whose role is to validate the message received before transmitting it by 8 bit bytes over the bus of the functional microprocessor 16, may comprise the same elements as the emission coupler 24, i.e. a microprocessor 54 associated with a clock recovery circuit 56 and a RAM 56. The interface 58 will again be formed of registers. In this interface has been shown an input 60 coming from a maintenance assistance device supplying elements to be used by the microprocessor 16.

The essential difference between the two couplers resides in the fact that the reception coupler 32 will have a RAM 56 with double access, structured in two separate parts. One of the parts, dedicated to emission, receives the message to be emitted from the functional microprocessor 16; the other part, dedicated to reception, receives from the microprocessor 54 of the coupler the message received and validated, i.e. corresponding for example to one of the two potential targets of the vehicle. The microprocessor 54 may be provided for analyzing the HDL vehicle set only if its initial part, forming an address field, corresponds to one of these potential targets. The microprocessor 54 may thus rapidly discriminate, among the messages received, those which relate to one of the targets.

I claim:

1. A process for data communication in the form of successive different messages, each consisting of multibit coded data between railways vehicles moving over a same track, including: sending each message to be transmitted from one of said travelling vehicles, in the form of a predetermined plurality of short identical transmissions of said message of multibit coded data at random times by modulating a directional microwave beam whose angular opening is sufficient in the horizontal direction for maintaining communication in bends of said track and switches and in the vertical direction for maintaining communication during changes in the profile of the track; and repeating each said message m successive times during a refreshment period T, each time at a random moment varying throughout the full length of a particular segment, of duration T/m.

2. A process according to claim 1, wherein m is of from 5 to 40.

3. A process according to claim 1, wherein the messages are sent with a power which depends on the communication conditions.

4. A process according to claim 3, wherein the messages are sent at a power selected between a nominal power and a reduced power.

5. A data communication system for communication of data in the form of short messages between vehicles moving over a track in a railway environment, comprising, on each of said vehicles, a transmission unit and a reception unit each connected by a respective interface to data processing means, comprising one or more microprocessors, the transmission unit comprising a coupler for encoding and formatting data received from the data processing means and means for transmitting the data several consecutive times and randomly during a same refreshment period each time at a random moment varying throughout the full length of a particular segment, of duration T/m, while the reception unit comprises a reception coupler, the purpose of which is to validate the message received before passing it to the data processing means.

6. A data communication system according to claim 5, wherein said data processing means comprises two microprocessors one of which for processing the "functional" data, the other for the "safety" data, said safety data being transmitted in coded form with a code increasing the redundancy and the detection of errors.

7. In a public transportation installation having a network of tracks, vehicles constructed and arranged to move along said tracks provided with means for remote controlled mutual connection and disconnection, a data communication system for communication of data in the form of short messages between vehicles moving over a track in a railway environment, comprising, on each of said vehicles, a transmission unit and a reception unit each connected by a respective interface to data processing means, comprising one or more microprocessors, the transmission unit comprising a coupler for encoding and formatting data received from the data processing means and means for transmitting the data several consecutive times and randomly during a same refreshment period, each time at a random moment varying throughout the full length of a particular segment, of duration T/m, while the reception unit comprises a reception coupler, the purpose of which is to validate the message received before passing it to the data processing means.

8. A data communication system according to claim 7, wherein each antenna is a horn, associated with an amplifying chain with frequency change.

9. A data communication system according to claim 5, wherein said reception unit comprises two antennae disposed at different positions in front of the vehicle and whose distance is at least equal to ten times the wave length in the air.

* * * * *